United States Patent [19]

Algaze

[11] 3,965,590

[45] June 29, 1976

[54] ARTICLES FOR CARRYING IDENTIFICATION

[75] Inventor: Isaac Algaze, Freeport, N.Y.

[73] Assignee: Rich Cue of Valley Stream Corporation, Freeport, N.Y.

[22] Filed: Jan. 3, 1975

[21] Appl. No.: 538,310

[52] U.S. Cl. ..... 40/19; 40/334

[51] Int. Cl.[2] ..... G09F 3/18

[58] Field of Search ..... 40/10 D, 19, 310, 334

[56] References Cited

UNITED STATES PATENTS

| | | | |
|---|---|---|---|
| 343,688 | 6/1886 | Barney | 40/19 |
| 451,028 | 4/1891 | Cowles | 40/19 X |
| 2,844,893 | 7/1958 | Keller | 40/306 |

*Primary Examiner*—Louis G. Mancene
*Assistant Examiner*—Wenceslao J. Contreras
*Attorney, Agent, or Firm*—Steinberg & Blant

[57] ABSTRACT

An article which is to carry identification. The article has an interior backing portion and an outer window situated in front of and spaced from the backing portion to define a predetermined gap therewith, the backing portion being visible through the window and the window being formed with a slit through which a strip may be introduced into the gap between the backing portion and window. Except for the latter slit the gap is entirely closed, and the article has a portion removably carrying the above strip so that after identification has been placed on a surface of the strip the latter may be introduced through the slit into the gap so that the surface of the strip which has the identification thereon will be visible through the window. The article may have an elongated, rod-shaped configuraion and may take the form of a cue, a golf stick, a bat, a ski pole, or the like, with the structure above preferably being situated at an end region of the article which is adapted to be gripped by the user thereof.

10 Claims, 6 Drawing Figures

ARTICLES FOR CARRYING IDENTIFICATION

BACKGROUND OF THE INVENTION

The present invention relates to articles which are to carry identification.

It is highly desirable to provide certain articles with identification so that, for example, the owner of the article can identify his own article. For example billiard or pool cues are customarily left by their owners at the establishment where they are used, and it is highly desirable for the owner of such an article to be able to identify his own cue when he visits the establishment for the purpose of playing billiards or pool. The same is true of various other types of articles, particularly in the case of games and sporting activities, such as bats, golf sticks, ski poles, and the like.

At the present time, articles of the above general type can carry the desired identification as by having such identification placed on a flexible strip which is adhered in some way to an exterior surface of the article. However, such expedients are not reliable. These identification strips can easily be removed by unauthorized individuals and if they are situated at a part of the article which is gripped by the user thereof, they create a certain discomfort. Moreover, the identification often becomes undesirably obscure. Of course, it is possible to provide suitable identification by way of carving or embossing the identification directly on the material of the article, but such procedures are expensive and inconvenient as well as being subjected to the possibility of becoming obscure with the passage of time.

SUMMARY OF THE INVENTION

It is accordingly a primary object of the present invention to provide an article which is to carry identification and which avoids the above drawbacks.

Thus, it is an object of the present invention to provide an article with the structure which is capable of providing the article with the desired identification in such a way that the identification will remain permanently visible over long periods of time.

Furthermore, it is an object of the present invention to provide a structure of the above type which does not create any problem, discomfort, or the like, in connection with the use of the article.

Furthermore, it is an object of the present invention to provide a structure of the above type which is simple and inexpensive and which at the same time has the capability of enhancing rather than detracting from the attractive appearance of the article.

According to the invention the article includes an assembly which has an interior backing portion and an outer window situated in front of and spaced from the backing portion to define a predetermined gap therewith, the backing portion being visible through the window while the window is formed with a slit through which a strip may be introduced into the gap to be situated between the backing portion and the window with a surface of the strip visible through the window. The assembly includes a means which closes the gap entirely, except for the slit through which the strip can be introduced into the gap, and the assembly has a portion which removably carries the above strip so that after identification is placed on the surface thereof which becomes visible through the window, the strip, having been removed from the portion of the article which removably carries the same, can be introduced through the slit into the window so that the identification on the surface of the strip will be visible through the window.

BRIEF DESCRIPTION OF DRAWINGS

The invention is illustrated by way of example in the accompanying drawings which form part of this application and in which.

DESCRIPTION OF A PREFERRED EMBODIMENT

Figure 1:
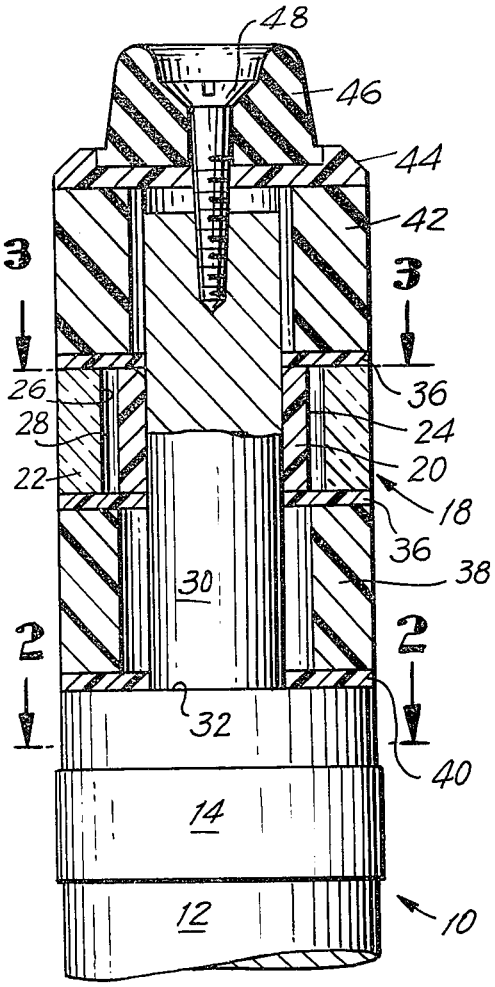
FIG. 1 is a fragmentary sectional elevation of one possible embodiment of the invention.
Figure 4:
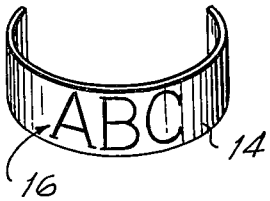
FIG. 4 is a perspective illustration of a strip having identification thereon.
Figure 2:
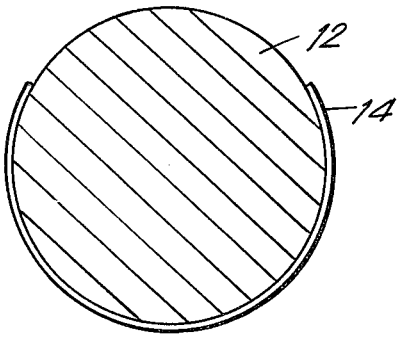
FIG. 2 is a transverse section taken along line 2—2 of FIG. 1 in the direction of the arrows.

Referring to FIG. 1, there is fragmentarily illustrated therein the upper portion of a cue adapted to be used in games such as billiards and pool. The illustrated upper end portion 10 of the cue is the part thereof which is gripped by the user of the cue. The elongated rod-shaped body which forms most of the cue, and which may be made of wood, for example, has a portion 12 shown at the lower part of FIG. 1, and this portion removably carries a strip 14 which is shown on the portion 12 in FIGS. 1 and 2 and which is shown by itself in FIG. 4. This strip 14 is of an arcuate configuration and is made, for example, of a springy plastic or metal so that it will resiliently grip the portion 12 of the cue 10 and thus will be carried thereby while being readily removable therefrom. As is apparent from FIGS. 2 and 4, the strip 14 extends around the axis of the portion 12 through more than 180°. It will be noted from FIG. 1 that the front, exposed convex surface of the strip 14 is blank. When the cue 10 is sold, the portion 12 thereof removably carries the strip 14 in the manner shown in FIG. 1. Thereafter, the owner of the cue will remove the strip 14 and will have placed on the front exposed convex surface thereof, in any suitable way, identifying indicia 16 indicated in FIG. 4. The indicia 16 may be engraved with the strip 14 having at its exterior convex surface a color which contrasts with the color of the interior of the strip 14 so that the indicia 16 will contrast sharply with the color of the exterior, convex surface of the strip 14. Any suitable procedures may be used for applying indicia 16 to the exterior convex surface of the strip 14.

Upwardly beyond the portion 12, the cue 10 carries an assembly 18 which has a construction in accordance with the present invention. This assembly 18 includes an interior backing portion 20 and an outer window 22. The window 22 may be made of a clear transparent plastic material so that the backing portion 20 is visible through the window 22, and the backing portion 20 may itself be made of a suitable plastic and may have an outer cylindrical surface 24 which is white, for example. The window 22 has an interior surface 26 which is spaced outwardly of and surrounds the surface 24 so as to define therewith a gap 28 which is adapted to receive the strip 14 in the manner described in greater detail below.

It will be noted that the cue 10 has an elongated extension 30 extending upwardly beyond the portion 12 and surrounded at its bottom end by the upwardly directed annular end surface 32 of the portion 12. This extension 30 may be integral with the portion 12 which in turn is integral with the remainder of the elongated rod which forms the cue 10. The backing portion 20 is in the form of a hollow cylinder which surrounds and engages the extension 30, and the window 22 is also in the form of a cylinder which surrounds and is spaced from the backing portion 20, these cylindrical members 20 and 22 being coaxial so that the gap 28 also is of a cylindrical configuration and is coaxial with the window 22 and the backing portion 20.

Figure 3:
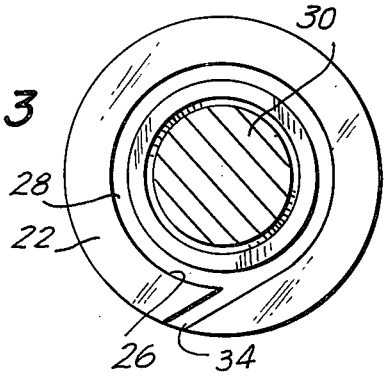
FIG. 3 is a transverse section taken along line 3—3 of FIG. 1 in the direction of the arrows.

For the purpose of introducing the strip 14 into the gap 28, the window 22 is formed with a slit 34 passing therethrough, and it will be seen that this slit 34 extends tangentially with respect to the inner surface 26 of the window 22, as is shown most clearly in FIG. 3. As will be apparent from the description below, this type of slit 34 greatly facilitates the introduction of the strip 14 into the gap 28.

A closing means is provided for closing the gap 28 at all parts thereof except the portion which communicates with the slit 34, so that access may be had to the gap 28 only through the slit 34. This closing means includes a pair of washers 36. The backing portion 20 and window 22 have equal widths, and washers 36 extend across the opposed ends of the members 20 and 22 so as to extend across the gap 28 and close the latter, except for the slit 34 which extends throughout the entire width of the window 22 between the top and bottom end surfaces thereof.

Between the annular end surface 32 of the portion 12 and the upper free end of the extension 30 is a pressing means for pressing the washers 36 toward each other and thus against the opposed ends of the window 22 and the backing portion 20. This pressing means includes a hollow cylindrical member 38 beneath and engaging the lower washer 36 of FIG. 1, this cylindrical member 38 itself engaging the top surface of a washer 40 which directly engages the annular surface 32. A cylindrical member 42 which is similar to the member 38 engages the top surface of the upper washer 36, and it will be noted that the cylindrical members 38 and 42 have hollow interiors of a diameter greater than the diameter of the extension 30. An outer end washer 44, which may be made of rubber, for example, engages the top end of the member 42 and is recessed at its upper surface so as to receive the lower end region of a rubber body 46 of a type which is conventional at the end of a cue which is gripped by the user thereof. This rubber member 46 is axially bored and countersunk in the manner shown in FIG. 1 so as to receive a fastening screw 48 which passes through the member 46 and through a central opening of the washer 44 so as to be capable of being threaded into the upper end portion of the extension 30, in the manner shown in FIG. 1. It will be noted that the outer diameters of the portion 12, the several washers, and the members 38 and 42 as well as the window 22 are all equal to each other, so that when all of these components are coaxially aligned the screw 48 may be tightened to hold the parts assembled in the condition shown in FIG. 1. This is the condition in which the article 10 is sold.

Figure 5:
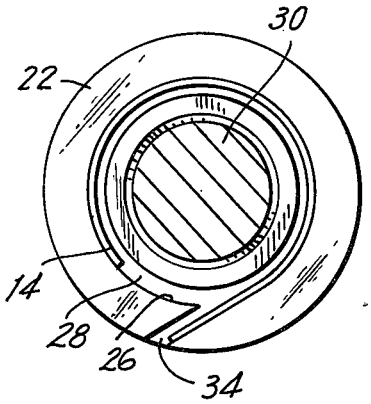
FIG. 5 shows the structure of FIG. 3 with the strip of FIG. 4 introduced into the structure of FIG. 3.

After purchasing the article the purchaser will remove the strip 14 and introduce it through the slit 34 into the gap 28, as pointed out above. Of course, prior to introduction of the strip 14 into the gap 28 the identifying indicia 16 will be placed on the outer convex surface of the strip 14 as described above. Because the slit 34 extends tangentially as shown in FIG. 3, it is a simple matter for the purchaser to introduce the strip 14 through one end thereof into the gap 28 with the strip 14 progressing along the interior of the gap 28 until the strip 14 has the condition shown in FIG. 5. Because the strip 14 initially extends along a circle whose diameter is greater than the diameter of the inner surface 26 of the window 22, when the strip 14 is introduced into the gap 28 to assume the condition shown in FIG. 5, the strip 14, due to its inherent resiliency, will press outwardly against the surface 26 so that in this way the strip 14 will reliably remain in the position shown in FIG. 5 with the surface of the strip 14 which carries the indicia 16 directly engaging the inner surface 26 of the window 22. In this way an excellent visibility for the identifying indicia 16 is assured.

Figure 6:
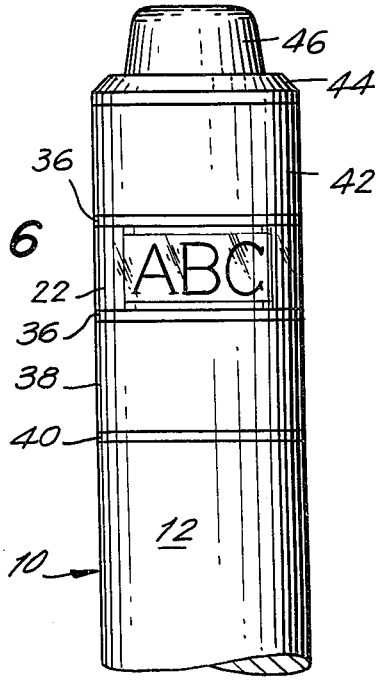
FIG. 6 is a fragmentary front elevation illustrating how the structure of FIG. 5 appears.

Thus, after the purchaser has carried out the operations set forth above, the cue 10 will have the appearance shown in FIG. 6.

It will be noted from FIG. 6 that the entire assembly of the invention has a constant outer diameter, up to the end washer 44, which equals the diameter of the portion 12, so that when the user manipulates the cue 10 there is no discomfort or any sensation of operating anything except a normal cue. At the same time, the identifying indicia is clearly visible through the window 22 and will reliably remain visible therethrough since the window 22 will maintain its clear transparent condition throughout the life of the cue and the identifying indicia is protected in the interior of the gap 28.

Thus, through the above relatively simple inexpensive structure of the present invention it becomes possible to provide the cue 10 with the capability of carrying identification in a manner which will avoid problems previously encountered with providing identification for articles such as cues.

Moreover, it is to be understood that while for the sake of a detailed description of the invention reference has been made above to the assembly of the invention as forming part of a cue, the assembly of the invention has a much wider applicability. Thus it is clear that the assembly of the invention may be used on many different types of rod-shaped articles, particularly articles which are used in games and other sporting activities, such as ski poles, golf sticks, bats, tennis rackets and the like. Furthermore, it is clear that the invention can have a much more general utility with all types of articles which are required to carry identification.

One of the outstanding advantages of the invention resides in the fact that the strip 14 cannot be easily removed from the gap 28. Without permanently destroying the article of the invention, it is only possible to remove the strip 14 by removing the fastening screw 48 and disassembling the structure, and because the fastening screw 48 is screwed tightly into the extension 30 it is not easy to remove the fastening screw 48.

what is claimed is:

1. In an article which is to carry identification, an assembly having an interior backing portion and an outer window situated in front of and spaced from said backing portion to define therewith a gap situated between said backing portion and window, said backing portion being visible through said window and said window being formed with a slit through which a strip can be introduced into said gap to become situated between said backing portion and window so that a surface of said strip becomes visible through said window, said assembly including a closing means closing said gap at all parts thereof except a region of said gap which communicates with said slit so that access may be had to said gap only through said slit, and said assembly having a portion removably carrying said strip so that the latter may be removed from the latter portion of said assembly and then introduced through said slit into said gap after a desired identification has been placed on said surface of said strip which becomes visible through said window after said strip has been introduced into said gap, said window and backing portion having opposed ends and said closing means engaging said opposed ends and extending across said gap for closing the latter at all parts except said region thereof which communicates with said slit, and pressing means engaging said closing means at said opposed ends of said window and backing portion and pressing said closing means against said opposed ends for maintaining said closing means assembled with said window and backing portion.

2. The combination of claim 1 and wherein said backing portion, window, and gap therebetween are all of a circular configuration and surround a common axis.

3. The combination of claim 2 and wherein said backing portion has an outer surface directed toward said window and said window has an inner surface directed toward said backing portion, the latter outer and inner surfaces being cylindrical and defining said gap therebetween and said slit extending substantially tangentially with respect to said inner surface of said window.

4. The combination of claim 3 and wherein said portion of said assembly which removably carries said strip is of a cylindrical configuration and said strip having a sufficient springiness to grip the latter portion of said assembly so as to be removably carried thereby, said strip having an arcuate configuration which facilitates the introduction thereof into said gap.

5. The combination of claim 4 and wherein said window has an exterior surface of a given diameter and wherein said portion of said assembly which removably carries said strip has an exterior surface portion on which said strip is removably mounted and which has substantially the same diameter as said exterior surface of said window.

6. The combination of claim 3 and wherein said assembly forms part of an article of elongated rod-shaped configuration.

7. The combination of claim 6 and wherein the elongated rod-shaped article is adapted to be used in games, sporting activities, and the like, said article being a cue, a golf stick, a ski pole, a bat, or the like.

8. The combination of claim 3 and wherein said portion which removably carries said strip is of a cylindrical configuration and fixedly carries at one end an elongated extension of a smaller diameter than and coaxial with said portion which removably carries said strip, said backing portion being of a cylindrical configuration and surrounding and engaging said extension while said window is also cylindrical and is spaced outwardly of and surrounds said backing portion, said backing portion and window having equal widths, and said closing means including a pair of washers respectively engaging opposed ends of said backing portion and window and extending across said gap.

9. The combination of claim 8 and wherein said portion which removably carries said strip has an annular end surface surrounding an end of said extension which is fixed to said portion, and said extension having an end distant from said annular end surface, and said pressing means being operatively connected with said end of said extension and said annular end surface and engaging said washers for pressing the latter toward each other and into engagement with said window and backing portion.

10. The combination of claim 4 and wherein said strip extends along a circle of larger diameter than said inner surface of said window so that said strip will press against said inner surface of said window when said strip is in said gap.

* * * * *